United States Patent [19]

Selsted

[11] 4,373,220

[45] Feb. 15, 1983

[54] POOL WATER LEVEL MAINTENANCE APPARATUS AND METHOD

[76] Inventor: Walter T. Selsted, 22385 Rancho Deep Cliff Dr., Cupertino, Calif. 95014

[21] Appl. No.: 228,598

[22] Filed: Jan. 26, 1981

[51] Int. Cl.[3] ..... F16K 1/18

[52] U.S. Cl. ..... 4/508; 137/428; 137/563; 4/509

[58] Field of Search ..... 137/428, 563; 4/507, 4/508, 509

[56] References Cited

U.S. PATENT DOCUMENTS 2,739,939 5/1956 Leslie ..... 137/428 X 4,211,249 7/1980 Richards ..... 4/508 X

*Primary Examiner*—Alan Cohan

*Attorney, Agent, or Firm*—A. C. Smith

[57] ABSTRACT

An improved water-level control method and apparatus automatically maintains the water level in a pool by selectively filling or draining water as required during the period that the circulating system is not operating.

6 Claims, 2 Drawing Figures

POOL WATER LEVEL MAINTENANCE APPARATUS AND METHOD

BACKGROUND OF THE INVENTION

Outdoor swimming pools and associated equipment are commonly constructed to operate with a water level that must be maintained within close limits. During hot, dry, windy weather, evaporation may cause the water level to drop as much as one inch per day. Water must be added regularly to replace the amount that evaporates or splashes out of the pool during use, and for the great majority of existing pools, this filling operation is performed manually. Failure to fill the pool to the requisite operating water level, even for a brief period, may result in damage to the associated pump, heater, and filter.

During rainy weather, a pool tends to fill above the desired operating water level, and the excess water must be removed. This may be accomplished by allowing the filter pump to deliver excess water to the same drain that is used when the filter is backwashed or cleaned. This draining operation is most commonly controlled manually, usually during heavy rains, to assure that the water level is not permitted to drop too low.

A small number of pools constructed recently in accordance with new code requirements include automatic overflow systems for draining of excess water, but an insignificant number of existing pools have any provisions for both draining and filling the pool automatically under all operating conditions.

Various techniques for filling or draining a pool are described in the literature (see, for example, U.S. Pat. Nos. 2,739,939; 2,809,752; 3,386,197; 3,739,405; 3,895,402; 3,908,206; 3,997,925; and 4,211,249).

The retrofitting of an existing pool with equipment for automatically controlling the water level commonly involves expensive and undesirable reconstruction of the pool and surrounding decking.

SUMMARY OF THE INVENTION

In accordance with the present invention, an improved apparatus and method for controlling the water level of a pool may be conveniently retrofitted into an existing pool. The dynamic operating conditions of existing pool equipment under the control of a time clock contribute to the proper operation of the present invention and insure that the water conduits of the invention will be flushed out periodically to prevent build-up of algae and rubble.

DESCRIPTION OF THE PREFERRED EMBODIMENT

Figure 1:
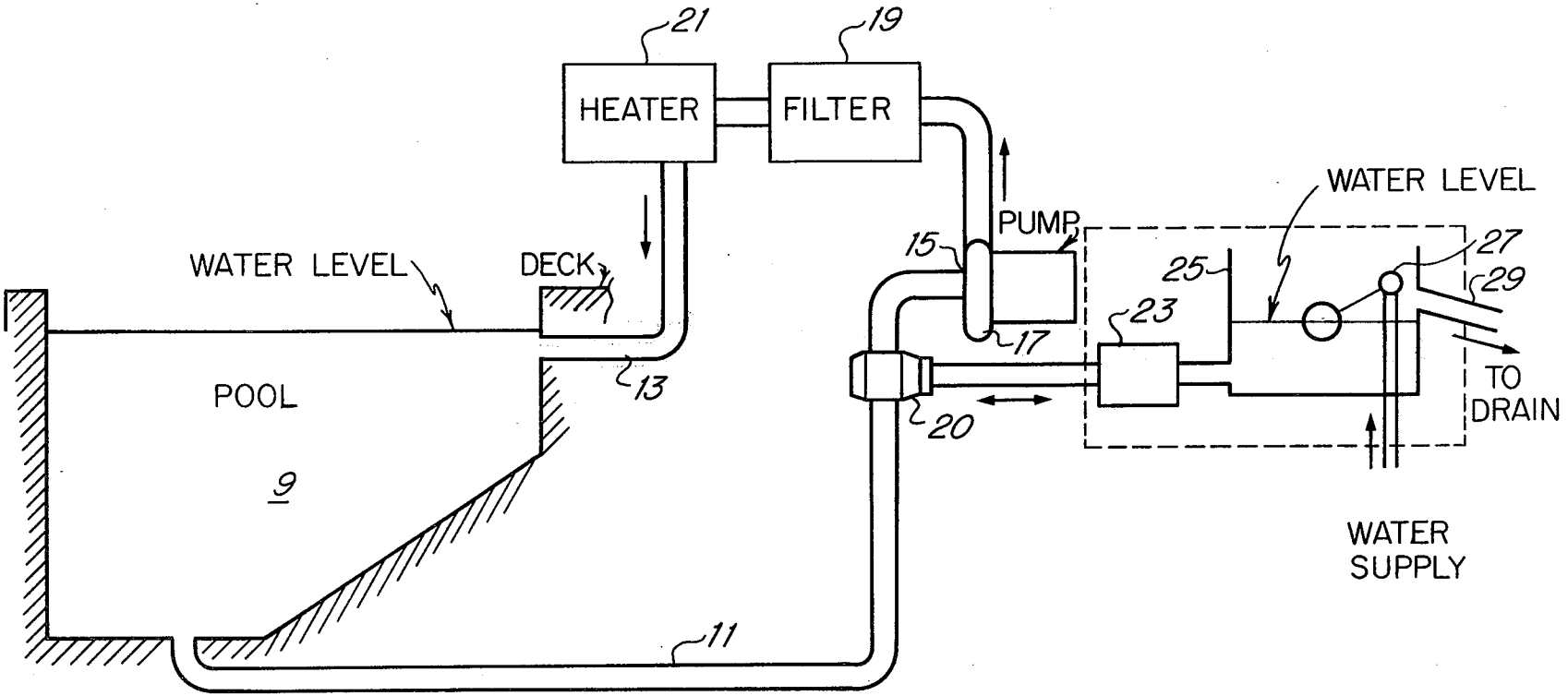
FIG. 1 is a pictorial diagram of a pool and associated equipment arranged according to one embodiment of the present invention.

Referring now to the pictorial diagram of FIG. 1, there is shown a pictorial cross-sectional view of a pool 9 having an outlet conduit 11 and an inlet conduit 13. Of course, the outlet conduit 11 may include a common surface-skimming tuyere located in a side wall of the pool near the desired water level. However, such detail forms no part of the present invention and is deleted for sake of clarity and simplicity of the description. Similarly, the inlet conduit 13 may include conventional pressure-operated pool-cleaning apparatus which also forms no part of the present invention and therefore is deleted for clarity.

The outlet conduit 11 extends from the pool 9 to the inlet port 15 of a water pump 17, and the inlet conduit 13 returns water to the pool 9 from the water pump 17 by way of a filter 19 and heater apparatus 21. The water-level control apparatus connects to the conduit 11 near the inlet port 15 of the water pump 17 and includes valving apparatus 23 and control tank 25. Water under pressure from a water supply is fed through a float- or level-actuated valve 27 to maintain the water in tank 25 at a desired level set by the float or level adjustment associated with valve 27. Also, the drain port 29 may be connected to a sewer or other sump and may be located at a selected incremental elevation above the desired water level set by the valve 27. This permits small increases in water level in tank 25 above the desired water level before excess water drains away.

Figure 2:
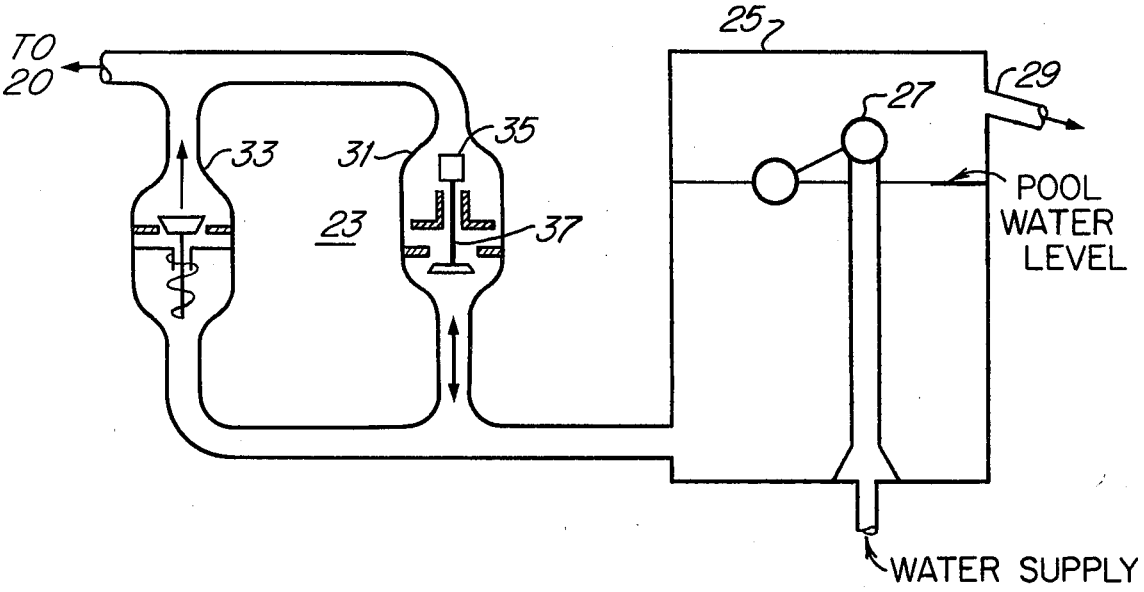
FIG. 2 is a pictorial sectional diagram of one embodiment of a valve mechanism according to the present invention.

The valving apparatus 23, as shown in FIG. 2, includes a shunt pair of valves 31 and 33 that connect the control tank 25 to the inlet port 15. In operation, the water pressure at the inlet port 15 with the pump 17 operating can be anywhere from 2 to 10 lbs/sq. in. below atmospheric pressure. Under this condition, valve 31 is closed by this pressure difference and isolates control tank 25 from the outlet conduit 11. Valve 33 is spring-biased against water flow therethrough for such normal pressure differences and therefore neither filling nor draining of the pool takes place during normal filtering and heating operation of the pump 17, filter 19 and heater 21.

When the pump 17 is turned off, for example, by timeclock means, the momentum of the water moving in the conduit 11 from the pool toward inlet port 15 forces some quantity of pool water through valve 31 and into control tank 25. When friction finally stops the flow of water, the level in tank 25 is higher than the level of water in pool 9, and this extra water flows slowly back into the pool through the same conduit 11 with valve 31 open. A small quantity of water may also run out the drain port 29 until the level in tank 25 equilibrates with the pool level. If water evaporated or splashed out of the pool 9 since the pump was turned on, the water level in tank 25 will be low and the valve 27 will allow water from the supply to enter the tank 25 and flow through open valve 31 until the pool level rises to the desired level set by valve 27. If the pool level is higher rather than lower than the desired level, the water level in tank 25 would rise and exit the system through drain port 29.

It is important to note that valve 31 is constructed to open when the pressure differential across the valve is low, and to close when the pressure differential across the valve is high. Thus, valve 31 opens when the pump 17 is not operating, thereby allowing free flow of water at low velocity in both directions. When the pump 17 is turned on, this valve 31 snaps shut due to the large pressure difference produced by the pump 17. The force exerted by weight 35 (or by a spring suitably oriented) is such that it can open the valve against a water pressure of approximately 0.1 to 0.25 lb/sq. in. This is because the pressure across the valve due to the water level in the pool 9 being about 6 inches low would be 0.25 lb./sq. in. and the valve must be able to open at any difference in level less than 6 inches. When water flowing through the check valve is filling the pool, the moving water tends to close the valve also, but this effect may be kept very small for low water velocity in a large-diameter conduit. It is also important to note that chlorinated water normally contained in the pool 9 flushes through valve 31 each time the pump turns off, and this prevents the build-up of algae. The valve means 23 may be coupled to the piping of an existing system using a clamp-type saddle connector 20 located close to the inlet of pump 17.

When the pump 17 turns on, a decrease of pressure of as little as 0.1 lb/sq. in. may close the valve. However, the decrease of pressure at the pump inlet 15 may cause the valve 31 to slam shut and set up a substantial differential pressure pulse across the valve 31, largely attributable to the sudden cessation of movement of the masses of the water columns in the connecting conduits. Care must be taken to prevent oscillating valve action in response to such a pressure perturbation, for example, by relieving excess pressure through shunting valve 33. This valve is configured for one-way flow therethrough in the direction toward the pump 17, and may be spring-biased to permit flow of water therethrough at pressures above about 10 to 12 lbs/sq. in., and may, of course, be arranged in any other pressure-relieving or shunting mode across valve 31, as desired. For example, the valve stem 37 of valve 31 may be hollow and contain the spring-biased, pressure-relieving valve 33 to relieve sufficient pressure upon initial closing to prevent oscillating valve action.

If the water level of the pool 9 increased since the pump turned on, for example, during heavy rain, then when valve 31 opens upon turn-off of the pump 17, the water levels in the pool 9 and tank 25 will equilibrate after the excess water drains away through port 29.

I claim:

1. Control apparatus for the level of water in a pool that is equipped with a water-circulating pump, the control apparatus comprising:

control tank means having an inlet port and a drain port which is disposed to be positioned at a selected elevation above a desired level of water in the pool;

first valve means positioned to supply water to the control tank means up to the desired level from a source of water under pressure; and second valve means coupled to the control tank means at a level below the desired level and to the inlet of the water-circulating pump for the pool, said second valve being biased normally open and being disposed to close in response to lower pressure on the side thereof coupled to the inlet of the water-circulating pump for permitting selective filling and draining of the pool through the second valve means only while the water-circulating pump of the pool is not operating.

2. Control apparatus as in claim 1 wherein said first valve means includes a valve mounted with respect to the control tank means to control the introduction of water into said tank from a supply of water under pressure in response to the level of water in said tank.

3. Control apparatus as in claim 1 wherein said second valve means is biased to open against a pressure differential thereacross not exceeding about 0.1 lb/sq. in.

4. Control apparatus as in claim 1 comprising third valve means biased against flow of water therethrough for pressures less than a selected value, said third valve means being coupled with the second valve means to the control tank means for passing water therethrough in response to pressures in excess of said selected value acting on the second valve means in its closed condition.

5. Control apparatus as in claim 4 wherein said third valve means is coupled in shunt around the second valve means between the control tank means and the inlet of the water-circulating pump.

6. Apparatus for connection to the water-circulating system of a pool comprising:

tank means having a drain port and an inlet port and having a water inlet for connection to a supply of water under pressure;

first valve means mounted within the tank means and coupled to the water inlet for controlling filling of the tank means up to a desired level in response to level of water in the tank means, said drain port being located within the tank means at a selected elevation above the desired level;

connection means for connecting to the water-circulating system of the pool; and valve means intermediate the connection means and the tank means and responsive to the pressure conditions in the water-circulating system for coupling the tank means to the water-circulating system for selectively filling or draining the pool relative to said desired level while said system is not operating.

* * * * *